United States Patent [19]

Price, Jr.

[11] 4,265,153

[45] May 5, 1981

[54] COPY MACHINE WITH AUTOMATIC ROLL SUPPLIED COPY PAPER FEEDING AND CUTTING APPARATUS AND CONTROL CIRCUITRY

[75] Inventor: Lawrence D. Price, Jr., Minnetonka, Minn.

[73] Assignee: Minnesota Mining and Manufacturing Co., St. Paul, Minn.

[21] Appl. No.: 118,198

[22] Filed: Feb. 4, 1980

[51] Int. Cl.[3] ..... B26D 5/38

[52] U.S. Cl. ..... 83/372; 83/156; 83/205; 83/210

[58] Field of Search ..... 83/205, 203, 210, 367, 83/372, 575, 364, 156

[56] References Cited

U.S. PATENT DOCUMENTS

| | | | |
|---|---|---|---|
| 3,533,691 | 10/1970 | Suzuki et al. | 83/205 X |
| 3,572,203 | 3/1971 | Woodham et al. | 83/205 X |
| 3,645,157 | 2/1972 | DiGiulio et al. | 83/205 |
| 4,193,330 | 3/1980 | Knox | 83/205 X |

*Primary Examiner*—Frank T. Yost

*Attorney, Agent, or Firm*—Cruzan Alexander; Donald M. Sell; Robert L. Marben

[57] ABSTRACT

Apparatus and control circuitry used in a copy machine for providing copy paper cut to length in accordance with an original sheet sensed by a single switch in the path of travel of the original. A first feed roller is rotated via a clutch upon energization of a solenoid for the clutch when the leading edge of the original is sensed by the switch to connect the solenoid to a D.C. power supply via a capacitor. When the capacitor is nearly charged, current flow to the solenoid has diminished to a level where the armature of the solenoid is returned to its unactuated position. The leading edge of the copy paper is moved from a solenoid operated cutter to a second feed roller by the rotation provided by the first feed roll in response to the energization of the solenoid for the clutch. The second feed roller continues to pull copy paper from a supply roll until the trailing edge of the original moves past the switch causing the switch to connect the charged capacitor to the cutter solenoid to energize it and operate the cutter.

3 Claims, 2 Drawing Figures

COPY MACHINE WITH AUTOMATIC ROLL SUPPLIED COPY PAPER FEEDING AND CUTTING APPARATUS AND CONTROL CIRCUITRY

BACKGROUND OF THE INVENTION

Field of the Invention

This invention relates generally to roll-fed copying machines and more particularly to the apparatus and control circuitry for dispensing cut lengths from a roll of copy sheet material in accordance with varying size originals and wherein switches responsive to the presence and absence of an original are used in the control circuitry.

While roll-fed copy machines are known which use one or more switches that are operated in accordance with the presence or absence of original sheets fed into the machine and/or the presence or absence of copy paper for controlling the movement of copy sheet material from a supply and the cutting of the material to length corresponding to the length of the originals, such prior arrangements are complex and relatively expensive. For example, the prior arrangements may require the use of special circuit components to provide pulsed operation of solenoids or the use of expensive continuous duty solenoids. In addition, many of the prior art arrangements require special control features or mechanisms to avoid jamming of copy paper at the cutter when the cutter is operated. While circuit complexity of the prior art was reduced by an arrangement using two switches disclosed in U.S. Pat. application Ser. No. 945,407, filed Sept. 25, 1978, now U.S. Pat. No. 4,193,330, careful adjustment of the switch positions is required which is time consuming and complicates maintenance when either of the switches requires replacement.

SUMMARY OF THE INVENTION

The complexity involved in prior copy machines is further reduced by this invention. The invention is utilized in an electrically operated copy machine having a transferring mechanism driven by a drive motor for providing synchronous movement in the copy machine of copy paper and original sheets of varying lengths. The copy paper for the machine is provided by a continuous web of copy paper from a copy paper supply roll. The invention provides apparatus and circuitry used in the copy machine which is responsive to the presence and absence of the original for cutting sheets from the copy paper which correspond to the length of the original and includes first and second copy paper feed rollers which are a part of the transferring mechanism. The first feed roller is positioned along the path of travel of the copy paper between the copy paper supply roll and said second feed roller. A solenoid operated cutter is positioned between the first and second feed rollers.

A solenoid controlled clutch is used for operatively connecting the first feed roller to the drive motor. The solenoid is energized only for the time necessary to have the first feed roller move the copy paper from an initial position at the cutter to the second feed roller which then continues to draw copy paper from the copy paper supply roll. Energization of the solenoid for the clutch and the solenoid for the cutter are controlled by a single switch which is positioned along the path of travel of an original sheet presented to the copy machine. The switch has a first and second position, the first position is the normal position for the switch and is provided when an original sheet is not presented to the switch with the second position provided while an original sheet is presented to the switch. The first position for the switch is used to complete a first circuit loop which includes a capacitor and the winding of the cutter solenoid. The second position of the switch completes a second circuit loop which includes the winding of the clutch solenoid, the capacitor and a D.C. power supply. Accordingly, the clutch solenoid is operated by the current flow for charging the capacitor when the leading edge of an original is initially detected by the switch to place it in its second position to complete the second circuit loop. The armature of the clutch solenoid is released as the current flow diminishes as the capacitor reaches full charge. When the trailing edge of the original passes the switch, the switch moves to its first or normal position which completes the first circuit loop that includes the capacitor, which is charged, and the winding of the cutter solenoid. This causes the cutter to be operated by discharge of the capacitor via the winding of the cutter solenoid. Accordingly, the cutter solenoid is operated to cut the copy paper to the length of the original presented to the copy machine.

With the foregoing arrangement provided by the present invention, only one switch is used to detect the original presented to the copy machine and is used in a manner so that the cutter solenoid and the clutch solenoid are only energized for a brief period of time allowing intermittent rather than continuus duty type solenoids to be utilized.

In addition, the single switch provides for operation wherein the feed roller is not active to push the copy paper into the cutter at the time the cutter is operated so any jamming of copy paper at the cutter is avoided.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION

Figure 1:
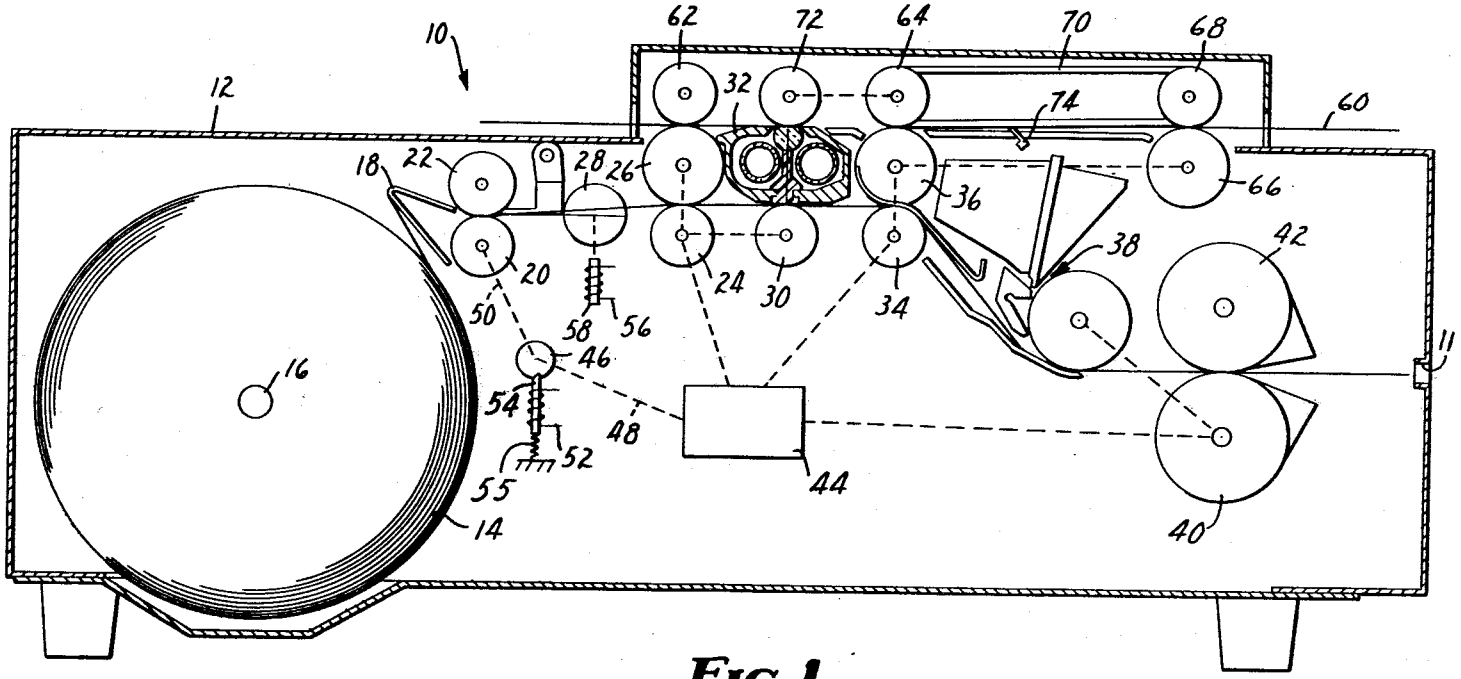
FIG. 1 is a diagrammatic side elevational view of an electrically operated copy machine with only a portion of the control circuitry of the present invention shown.

Referring to FIG. 1, a diagrammatic side elevational view of an electrically operated copy machine 10 is shown in part which includes a housing 12 in which a copy paper supply roll 14 is positioned for rotation counterclockwise about the axis for the roll indicated at 16. For the type of copy machine to be described, the copy paper is a zinc oxide coated paper such as that available from the Minnesota Mining and Manufacturing Company under the designation Type 470. The copy paper is moved through the copy machine by a transferring mechanism which includes a first feed roller 20 which receives the copy paper from the supply roll 14 via a guide member 18, an idler roller 22 above roller 20 between the copy paper is moved when roller 20 is driven, a second feeder roller 24 and a cooperating charge roller 26 positioned above roller 24 which also serves to place a uniform electrical charge on the zinc oxide surface of the copy paper, a roller 30 which receives the copy paper from rollers 24 and 26 and keeps it in close contact with the exposure station, indicated generally at 32, drive roller 34 plus roller 36 positioned above roller 34 which receive the paper from roller 30 and move it past a developer station, indicated generally at 38, and a driven pressure roller 40 and a cooperating idler roller 42 positioned above the roller 40 which receive the copy paper from the rollers 34 and 36 and move the copy paper via an opening 11 in the housing 12 to an area outside of the housing. The path taken by the copy paper is shown by the solid line that extends from the copy paper to the right side of the housing.

A drive motor 44 is also a part of the transferring mechanism and provides the driving force for the transferring mechanism. A direct drive connection, indicated by dotted lines, is provided between the drive motor 44 and feed roller 24, drive roller 34 and roller 40. A chain drive (not shown) may be used to provide the direct drive connection. The drive motor 44 is also operatively connected to drive the feed roller 20 via a solenoid operated clutch 46 as indicated by the dotted line 48 between motor 44 and clutch 46 and the dotted line 50 between the clutch 48 and feed roller 20. The drive relationship between the clutch 46 and the motor 44 and between the clutch 46 and the feed roller 20 is only diagrammatically shown.

The clutch 46 may be a spring clutch available from the PSI Division of Warner Electric Brake and Clutch Company, P.O. Box 118, Pittman, N.J. 08071 under stock number 501581. The clutch 46 is controlled by a solenoid which includes a winding 52 and an armature 54, which by spring 55 is biased toward clutch 46. When the winding 52 is energized, the armature 54 moves allowing the clutch 46 to couple the drive motor 44 to the feed roller 20. If the winding 52 is de-energized before the clutch 46 rotates one revolution, the clutch is engaged by the armature to terminate movement of the roller 20 after one revolution of the clutch. As will be explained later, one revolution of roller 20 is required when making a copy using the machine shown in FIG. 1.

A solenoid controlled cutter 28 is provided along the path of the copy paper and is positioned between the first feeder roller 20 and the second feeder roller 24. Normally, the copy paper will be at the cutter 28 when a copy has been made with the cutter bar portion of the cutter 28 positioned to allow paper to move to the second feed roller 24 when the first feed roller 20 is driven. The spacing between the cutter 28 and the roller 24 is such that only one revolution of the feed roller 20 is required to bring the copy paper to the second feed roller 24. The solenoid for cutter 28 includes a winding 56 and an armature 58 which is operatively connected, as indicated by the dotted line, to the cutting bar portion of the cutter 28. The cutter 28 is moved to the cutting position when the winding 56 is energized and returns to its original position when winding 56 is de-energized to cause the armature 58 to return to the de-energized position. Solenoid controlled cutters of the type described for severing paper presented to it from a feed roller are well known in the art.

It is necessary when making a copy of an original sheet that movement of the original sheet to be copied and the copy paper be synchronized so their leading edges reach the exposure station 32 at the same time. The transferring mechanism of the copy machine that serves to provide such movement of an original sheet includes a portion of the transferring mechanism used in moving copy paper through the machine. An original passes in FIG. 1 from right to left along the path indicated by the line 60.

The charge roller 26 and the feed roller 24, which are used in the transferring mechanism for the copy paper, are also used directly as part of the transferring mechanism for the original sheets presented to the copier. Roller 24 is coupled, as indicated by the dotted line, to drive charge roller 26. Gears can be used to provide the coupling. An idler roller 62 is positioned above and cooperates with roller 26. A similar coupling arrangement is provided between rollers 34 and 36 with roller 64 positioned above roller 36. The roller 36 is also coupled, as indicated by the dotted line, to drive a feed roller 66 positioned at the right portion of the machine where an original is initially inserted. The roller 36 may be coupled to the feed roller 66 by a timing belt (not shown). The feed roller 66 has a roller 66 positioned above it which is coupled to the roller 64 by a number of "o" ring belts 70 (only one is shown) positioned along the rollers 68 and 64. A roller 72 is positioned adjacent the exposure station 34 diametrically opposite the roller 30. The roller 72 is biased toward the exposure station and is a driven roller being coupled, as indicated by the dotted line, to roller 64. Such coupling can be provided by a timing belt (not shown). With the drive motor 44 for the transferring mechanism operating, the portion of transferring mechanism is effective to move an original sheet along the path indicated by the line 60 carrying the original past the exposure staton 32 to an exit point to the left of rollers 26 and 62.

A snap acting type switch 74 of the single pole, double throw configuration, is positioned in the flow path for the original. A switch of this type is well known and commercially available from several sources. Switch 74 is operated by the leading edge of an original sheet and is positioned so its actuation in response to the leading edge occurs when the leading edge is at a distance from the center of the exposure station 32 that is equal to the distance that the leading edge of the copy paper, which is at the cutter 28, travels to reach the center of the exposure station 32 following energization of the winding 52. As will be explained, the actuation of switch 74 in response to the leading edge of the original is effective to energize the winding 52 of the solenoid for clutch 46 to release clutch 46 allowing the feed roller 20 to be driven. As will be explained, the armature 54 of the solenoid for clutch 46 is released since current to the solenoid is reduced before the feed roller 20 has rotated a full revolution allowing the armature 54 to stop operation of the clutch.

Figure 2:
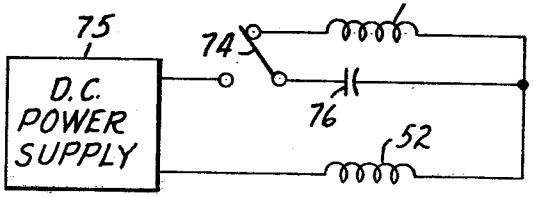
FIG. 2 is a schematic of the control circuitry of the present invention for use with the copy machine of FIG. 1.

A control circuit utilizing switch 74 is shown in FIG. 2. The position in which switch 74 is shown shall hereinafter be referred to as the first position. It is the position the switch automatically assumes when it is not responding to the presence of an original sheet. The other position, which is assumed by the switch 74 when responding to an original sheet, shall hereinafter be referred to as the second position. The control circuit includes a D.C. power supply 75 which has one output connected to the fixed contact of switch 74 associated with the second position of switch 74. The fixed contact of switch 74 associated with the first position of switch 74 is connected to one end of the winding 56 for the cutter solenoid. The other end of the winding 56 is connected to one end of winding 52 of the solenoid for clutch 46. The other end of winding 52 is connected to the other output of the D.C. power supply 75. A capacitor 76 is connected between the movable contact of switch 74 and the connection common to the windings 52 and 56. When switch 74 is in its first position, a first circuit loop including winding 56 and capacitor 76 is completed. When switch 74 is in its second position, a second circuit loop is completed which includes the D.C. power supply 75, capacitor 76 and winding 52.

Operation of the circuit of FIG. 2 in conjunction with movement of the copy paper and an original sheet through the copy machine will be described. Prior to the insertion of an original sheet into the copy machine, the circuit of FIG. 2 is as shown, wherein each of the windings 52 and 56 is de-energized so the leading edge of the copy paper is at the cutter 28 where it remains until the clutch 46 is released by energization of the solenoid winding 52 to cause feed roller 20 to be driven. Assuming the drive motor is energized, the original sheet is carried by the roller 66 and 68 and the "o" ring belts 70 toward the snap switch 74. Upon actuation of the switch 74 to its second position by the leading edge of the original sheet, the second circuit loop is established. This causes the winding 52 for the clutch solenoid to be energized by the D.C. current flow established for charging the capacitor 76. With the clutch solenoid winding 52 energized, the clutch 46 is released causing the drive motor 44 to drive the feed roller 20 to move the leading edge of the copy paper toward the driven feed roller 24. The current flow for charging capacitor 76 becomes less as the capacitor 76 reaches full charge causing the armature 54 of the clutch solenoid to return to its de-energized position. The time for charging the capacitor 76 is short enough that the return of the armature 54 to its de-energized position occurs before roller 20 has made one or two revolutions to cause the armature of the solenoid to disengage the clutch from the roller 20 upon completion of one or two revolution of roller 20. The spacing of rollers 24 and 26 from the cutter 28 is such that one revolution of roller 20 is sufficient to move the leading edge of the copy paper from the cutter 28 to rollers 24 and 26 so movement of the copy paper is continued by rollers 24 and 26 following disengagement of the clutch from roller 20.

Movement of the copy paper via rollers 24 and 26 and the original sheet via rollers 66 and 68 plus rollers 36 and 64 causes both leading edges to reach the center of the exposure station 32 at the same time. This causes an electrical charge image to be placed on the copy paper in accordance with the light energy directed from the original to the copy paper via the exposure station. During further travel, the copy paper proceeds via rollers 34 and 36 past the developer station 38, where toner is deposited on the copy paper in accordance with charge image, to the pressure fuser station provided by rollers 40 and 42 where the toner image is fused to the copy paper by pressure.

When the trailing edge of the original sheet passes the switch 74, switch 74 returns to its first position to complete the first circuit loop. The charged capacitor 76 is discharged via the winding 56 of the cutter solenoid causing the cutter 28 to be operated to sever the copy paper at the cutter allowing the severed portion, which is cut the length of the original sheet presented to the copy machine, to complete its path through the copy machine in synchronism with passage of the original sheet through the copy machine.

It will be noted from the foregoing description of the operation of the circuit of FIG. 2 that neither of the windings 52 or 56 for the solenoids remains energized for any appreciable time making it possible to use solenoids which are of the intermittent duty type rather than of the constant duty type as are required by other cut-to-length arrangements for copy machines and the like.

What is claimed is:

1. An electrically operated copy machine having a transferring mechanism driven by a drive motor for providing synchronous movement in the copy machine of copy paper and original sheets of varying lengths where the copy paper is provided by a continuous web of copy paper from a copy paper supply roll and apparatus and circuitry responsive to the presence and absence of the original for cutting sheets from the copy paper which correspond to the length of the original including:

first and second copy paper feed rollers included in the transferring mechanism, said first feed roller positioned between the copy paper supply roll and said second feed roller;

first and second solenoids, each having a winding;

a capacitor having one side connected to one end of each of said windings;

a D.C. power supply having one side connected to the other end of said second solenoid winding;

a cutter positioned in the path of travel of the copy paper between said first and second feed rollers and operatively connected to said first solenoid;

switch means positioned along the path of travel for an original sheet presenting a first position and a second position in response to the absence and presence, respectively, of an original sheet presented to the copy machine at said switch means, said switch means operatively connected to said other end of said first solenoids, the other side of said capacitor and the other side of said D.C. supply voltage forming a first circuit loop including said first solenoid winding and said capacitor when said switch means is presenting said first position and forming a second circuit loop including said D.C. supply source, said capacitor and said second solenoid winding when said switch means is presenting said second position, said second circuit loop when formed causing said capacitor to be charged and causing said second solenoid winding to be energized while said capacitor is being charged and said first circuit loop when formed subsequent to the formation of said second circuit loop causing said first solenoid winding to be energized by the discharge of said capacitor; and a clutch adapted for control by said second solenoid and operatively engaged between the drive motor and said first feed roller for providing sufficient rotation of said first feed roller to move the copy paper from said cutter to said second feed roller following energization of said second solenoid.

2. An electrically operated copy machine in accordance with claim 1 wherein said first switch means is a snap switch.

3. An electrically operated copy machine in accordance with claim 1 wherein said snap switch is a single pole, double throw type.

* * * * *

UNITED STATES PATENT AND TRADEMARK OFFICE

CERTIFICATE OF CORRECTION

PATENT NO. : 4,265,153

DATED : May 5, 1981

INVENTOR(S) : Lawrence D. Price, Jr.

It is certified that error appears in the above-identified patent and that said Letters Patent are hereby corrected as shown below:

Column 3, line 2, add "which" after --between--.

Column 4, line 25 change "66" (second occurrence) to --68--.

Signed and Sealed this

*Eighteenth* Day of *August 1981*

[SEAL]

*Attest:*

GERALD J. MOSSINGHOFF

*Attesting Officer*

*Commissioner of Patents and Trademarks*